United States Patent [19]

Holestine

[11] Patent Number: 5,022,445

[45] Date of Patent: Jun. 11, 1991

[54] LOG SPLITTER AND EXIT CONVEYOR

[76] Inventor: William H. Holestine, 474B Prairie La., Sedro Woolley, Wash. 98284

[21] Appl. No.: 572,077

[22] Filed: Aug. 22, 1990

[51] Int. Cl.[5] ..... B27L 7/00

[52] U.S. Cl. ..... 144/193 A; 144/193 E; 144/366

[58] Field of Search ..... 144/3 K, 193 R, 193 A, 144/193 E, 366

[56] References Cited

U.S. PATENT DOCUMENTS

| | | | |
|---|---|---|---|
| 508,221 | 11/1993 | Hill | 144/193 |
| 3,974,867 | 8/1976 | Butas, Jr. | 144/193 A |
| 4,019,549 | 4/1977 | Williams | 144/193 A |
| 4,076,061 | 2/1978 | Greeinger | 144/3 K |
| 4,160,470 | 7/1979 | Sigmund | 144/193 A |
| 4,269,242 | 5/1981 | Smith et al. | 144/3 K |
| 4,286,638 | 9/1981 | Connolly et al. | 144/3 K |
| 4,303,112 | 12/1981 | Sconce | 144/193 A |
| 4,337,809 | 7/1982 | Bentolette | 144/3 K |
| 4,388,957 | 6/1983 | Schilling | 144/366 |
| 4,478,263 | 10/1984 | Johnston | 144/3 K |
| 4,800,937 | 1/1989 | Mangus, Sr. | 144/193 E |
| 4,834,154 | 5/1989 | Nunnery et al. | 144/3 K |
| 4,842,030 | 6/1989 | Neter | 144/193 A |
| 4,860,806 | 8/1989 | Brace | 144/193 E |
| 4,936,362 | 6/1990 | Heikkinen | 144/3 K |
| 4,951,726 | 8/1990 | Sieverin | 144/366 |

*Primary Examiner*—W. Donald Bray

*Attorney, Agent, or Firm*—Ward Brown; Robert W. Beach

[57] ABSTRACT

A double-acting hydraulic ram drives a log section or block through a blade assembly to split the log section into several smaller pieces. The blade assembly is configured to minimize the force required to split the log section into several pieces without jamming. More specifically, such assembly includes a vertical blade having a splitting edge inclined rearward in the direction of movement of the block section toward such blade and horizontal wings cantilevered from such vertical blade. Each wing is swept outward and rearward from the vertical blade and has a leading edge staggered rearward from the splitting edge of the vertical blade. An exit conveyor is provided with a chain and flight members driven solely by the reciprocating action of the ram for transporting the split pieces to a desired location.

15 Claims, 4 Drawing Sheets

LOG SPLITTER AND EXIT CONVEYOR

BACKGROUND OF THE INVENTION

1. Field of the Invention

The present invention relates to the general field of log splitters, particularly splitters having rams for driving log sections or blocks through one or more splitting blades.

2. Prior Art

The following U.S. patents illustrate splitters and accessories therefor, including feed mechanism, cut-off saws, different types of blade assemblies and exit mechanism, for more or less automated high speed splitting of blocks or log sections:

U.S. Pat. No. 508,221, issued Nov. 7, 1893 (Hill);
U.S. Pat. No. 3,974,867, issued Aug. 17, 1976 (Butas, Jr.);
U.S. Pat. No. 4,286,638, issued Sept. 1, 1981 (Connolly et al.);
U.S. Pat. No. 4,388,957, issued June 21, 1983 (Schilling);
U.S. Pat. No. 4,478,263, issued Oct. 23, 1984 (Johnston);
U.S. Pat. No. 4,834,154, issued May 30, 1989 (Nunnery et al.);

The following U.S. patent illustrate smaller, portable splitters:

U.S. Pat. No. 4,303,112, issued Dec. 1, 1981 (Sconce);
U.S. Pat. No. 4,842,030, issued June 27, 1989 (Meyer).

SUMMARY OF THE INVENTION

The present invention provides a log splitter of the type using a double-acting hydraulic ram to drive a log section or block through a blade assembly. Such blade assembly is configured to minimize the force required to split the log section into several pieces without jamming. In addition, an exit conveyor is provided which is driven solely by the reciprocating action of the ram for transporting the split pieces to a desired location.

DETAILED DESCRIPTION

Figure 1:
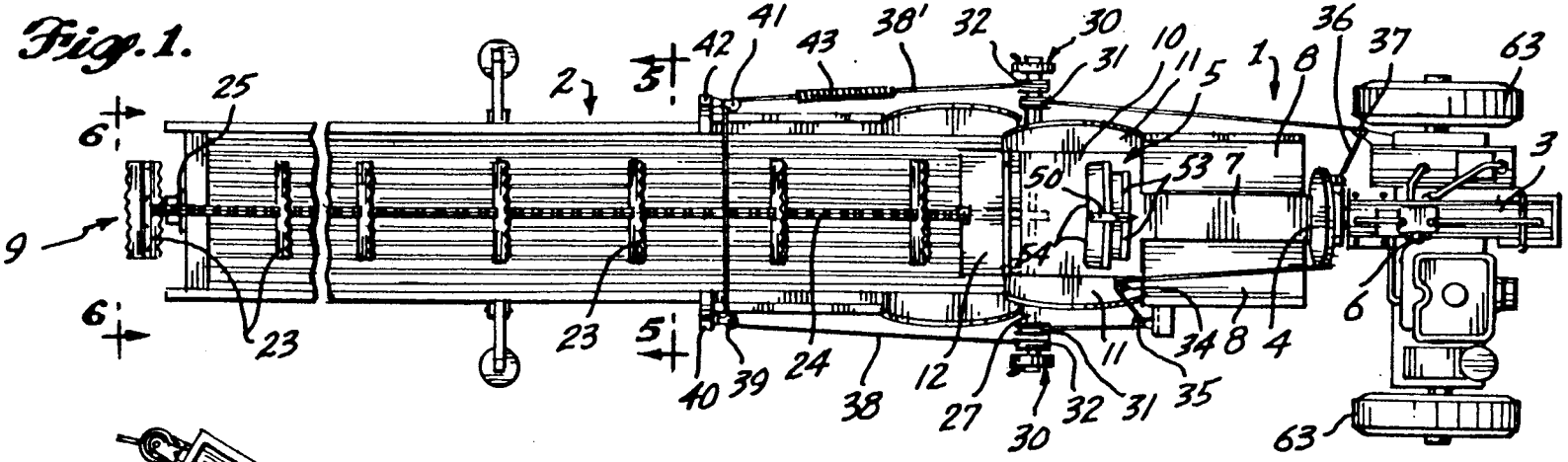
FIG. 1 is a top plan of a log splitter and exit conveyor in accordance with the present invention.
Figure 2:
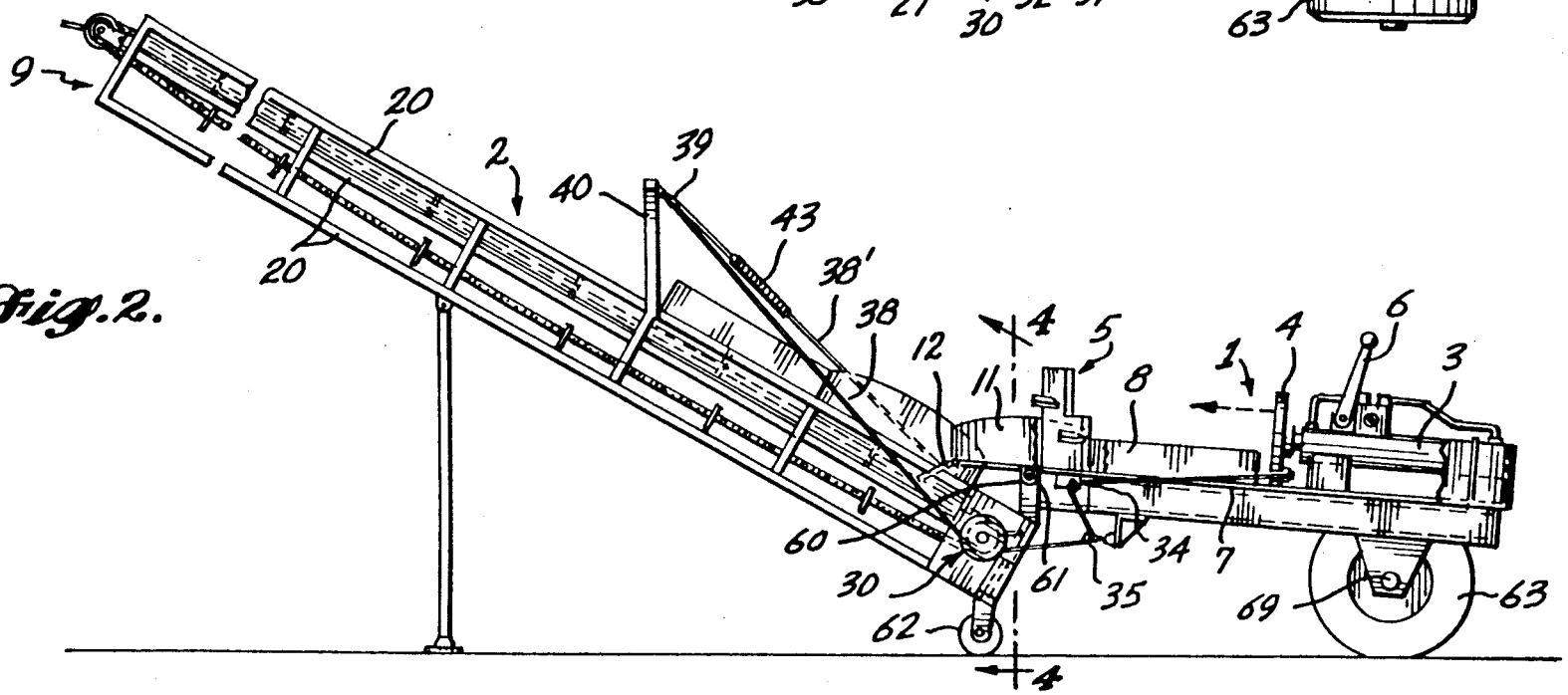
FIG. 2 is a left side elevation of the log splitter and exit conveyor of FIG. 1, with parts broken away.

With reference to FIGS. 1 and 2, the log splitter 1 and exit conveyor 2 in accordance with the present invention are used for splitting log sections into smaller pieces, such as for firewood, and to convey the smaller pieces automatically to a remote location where they are discharged.

The splitter 1 has a double-acting hydraulic ram 3 of conventional design with a reciprocating front upright pusher plate 4. Such plate is movable toward and away from a modified splitter head or blade assembly 5 by manipulation of an operating handle 6. With the pusher plate in its retracted position illustrated in FIGS. 1 and 2, a log section or block of appropriate length is inserted onto the rigid rail 7 between the pusher plate and the blade assembly, whereupon the handle 6 is manipulated to actuate forward movement of the pusher plate by extension of the plunger of the ram. The log section is loosely confined on the rail 7 by outward and upward extending aprons 8 as the section is moved toward the blade assembly 5. One extension of the pusher plate drives the log section most of the way through the blade assembly.

When the pusher plate has reached its forwardmost position, the handle 6 is manipulated to retract the pusher plate such that another log section can be inserted, whereupon the process is repeated. The preceding log section will be forced all the way through the blade assembly 5 by forward movement of the next section, resulting in the first section being split into smaller pieces by movement through the blade assembly. In accordance with the present invention, such pieces are pushed onto the exit conveyor 1 which gradually conveys the split pieces away from the splitter to the outlet end 9 of the conveyor from which the segments fall or are guided to a desired location such as the bed of a truck.

Figures 3, 4, 5, 6:
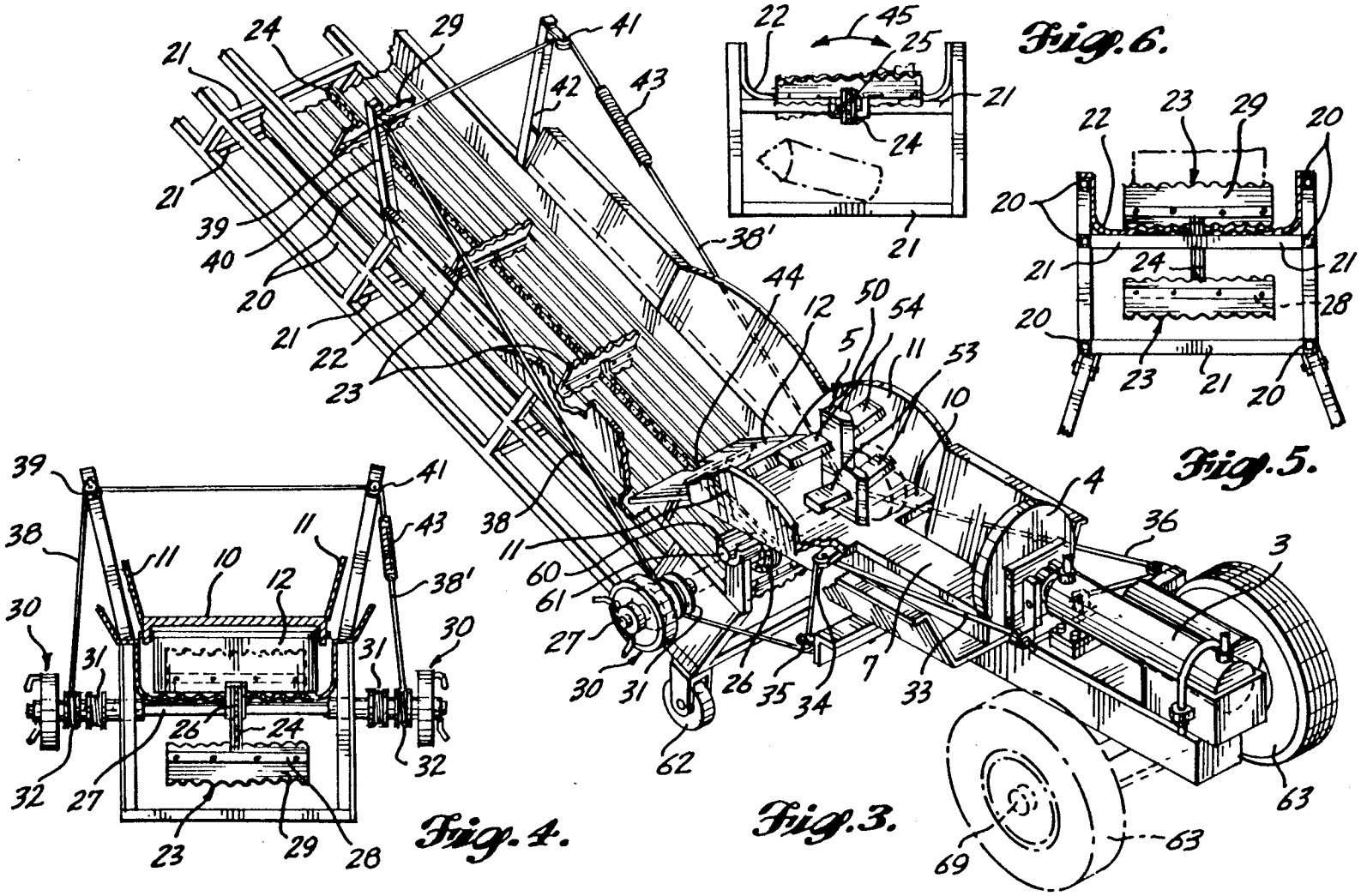
FIG. 3 is a fragmentary top rear perspective of the bottom portion of the log splitter and exit conveyor shown in FIGS. 1 and 2, with parts broken away.
FIG. 4 is a section taken along line 4—4 of FIG. 2.
FIG. 5 is a section taken along line 5—5 of FIG. 2.
FIG. 6 is a front end elevation taken from line 6—6 of FIG. 2.

As seen in FIG. 1 and FIG. 3, the rail 7 on which the log sections are supported prior to being split widens into a table 10 adjacent to and behind the blade assembly 5. Such table also has upward and outward inclined apron portions 11 for retaining the smaller split pieces on the table. Subsequent forward movement of a succeeding log section pushes the smaller pieces from the table 10 onto the exit conveyor 22. Preferably the lower end of the conveyor is located below the table. A slide plate 12 is inclined downward from the forward end of the table 10 to the rear end portion of the conveyor.

The exit conveyor 2 includes a box framework of top, bottom and central beams 20 at each side of the conveyor. Beams 20 are interconnected by lower and upper cross members 21, as best seen in FIGS. 3 and 5. The interconnected box frames, particularly the upper cross members 21, support an elongated carrier member in the form of an upward-opening sheet metal trough 22. As best seen in FIG. 5, the bottom of the trough preferably is corrugated for ease of sliding of the split wood pieces along the trough.

Sliding movement of the split pieces along the trough is achieved by transversely extending flights 23 secured to a central endless chain 24. Such chain extends around sprockets supported at opposite ends of the conveyor including the upper sprocket 25 at the exit end of the conveyor, best seen in FIGS. 1, 2 and 6, and the bottom sprocket 26 carried on a drive shaft 27, best seen in FIGS. 3 and 4.

Flights 23 preferably include rigid metal crossbars 28 secured to the chain 25 and somewhat flexible rubber-reinforced canvass paddles 29 clamped or otherwise affixed to the crossbars. Each paddle has sawtoothed top and bottom edges. Along the upper run of the chain, the bottom sawtoothed edges of the paddles slide along the corrugated bottom of the trough 22 and hold the chain above the bottom of the trough.

Movement of the chain 24 to transport the flights along the trough is achieved by rotation of the drive shaft 27. Such shaft has a ratchet coupling 30 at each end. The couplings include inner and outer cable reels 31 and 32, respectively, rotated conjointly on the drive shaft and acting as the driving member of the coupling. For each coupling, rotation of the cable reels in one direction imparts driving rotation to the drive shaft, but the shaft can overrun the reels, i.e., turn in a forward direction even when the reels are stationary or moved in reverse.

As seen in FIG. 3, a first drive cable 33 has one end portion connected to the ram pusher plate 4 and extends forward to a pulley 34 located below the trailing edge of the table 10, then downward and slightly rearward to another pulley 35 and then forward to the inner drive reel 31 of the ratchet coupling 30 at the left side of the drive shaft (looking forward from the splitter).

With reference to FIG. 1, at the right side of the splitter a second drive cable 36 has one end connected to the rear of the pusher plate 4 and extends rearward and outward to a pulley 37. From pulley 37, drive cable 36 extends forward to the inner reel 31 of the ratchet coupling 30 at the right end of drive shaft 27.

The outer reels 32 of the coupling 30 are interconnected by rewind cables 38 and 38' having end portions wound on their respective outer reels. As best seen in FIG. 3, cable 38 extends from its outer reel upward and forward to a pulley 39 mounted on a post 40, then high above and across the upper run of the conveyor to a pulley 41 on a second post 42, and then downward and rearward to the upper end of a tension spring 43. Cable 38' extends from its outer reel to the other end of the tension spring.

Each ratchet coupling 30 acts as part of a one-way drive for the drive shaft 27 carrying the bottom drive sprocket 26 for the conveyor chain 24. On the drive stroke (extension) of the pusher plate 4, the right drive cable 36 is pulled so as to rotate its inner reel 32 and impart forward driving rotation to the drive shaft 27. At the same time, some accommodation must be made for loosening of the left drive cable 33 as the pusher plate moves forward and the drive shaft overruns the left ratchet coupling. During such extension of the pusher plate, the right rewind cable 38' is automatically wound on its reel 31, thereby pulling the left rewind cable 38 from its reel in a direction to wind up the left drive cable 33 as it loosens.

Similarly, when the pusher plate 4 moves from its forwardmost position back to the position shown in FIG. 1, drive cable 33 is pulled in a manner to rotate the left outer reel 32 of ratchet coupling 30 so as to impart forward rotation to the drive shaft. At the same time, rewind cable 38 is wound on its reel 31 and rewind cable 38' is pulled in a direction to wind up the right drive cable 36.

The net result is that the conveyor chain is moved incrementally forward on each upstroke and on each backstroke of the pusher plate. The paddles 29 pick up the split pieces as they slide down the plate 12. Such plate has a notch 44 for the chain 24 and prevents wood pieces moved onto it from sliding downward to the rear off the exit conveyor. Plate 12 is pivotally connected to the leading edge of the table 10 so that it can swing upward as each paddle passes beneath it, whereupon it falls back to the position shown in the drawings in which its bottom edge remote from the table engages against the bottom of the trough.

The somewhat flexible paddles with sawtooth edges are extremely effective for picking up the split pieces and incrementally carrying and sliding them along the trough toward its outlet end 9. At such outlet end, the upper sprocket 25 is mounted so as to be turnable about generally the longitudinal axis of the exit conveyor as represented by the arrow 45 in FIG. 6. This permits a flight on which a split piece is resting unevenly to swing clockwise or counterclockwise as viewed in FIG. 6 when the flight clears the end of the trough so as to allow the piece to fall to the right or left rather than have its full weight bear unevenly on the flight.

Figure 7B:
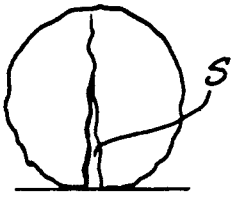
FIG. 7B is a diagrammatic front end elevation of such log section illustrating the extent to which it has been split.
Figure 7A:
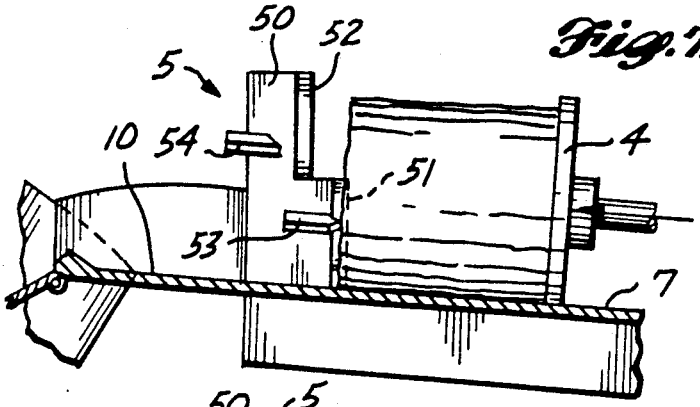
FIG. 7A is a diagrammatic fragmentary left side elevation of a portion of the splitter in accordance with the present invention illustrating a first position of a log section to be split.

The splitter head or blade assembly 5 is constructed for efficient splitting of a log section or block into several pieces without severe power requirements or jamming. As illustrated in FIG. 7A, the blade assembly includes an upright knife 50 with a bottom upright splitting edge 51 and an upper upright splitting edge 52 spaced above and rearward from such bottom edge. Both such edges preferably are inclined rearward relative to the wood-supporting surface of the rail 7 and table 10. The result is that the log section to be split first engages edge 51 at the bottom of the log section rather than at the middle or contiguously along a substantial portion of the leading face of the log section. It has been found that less force is required to split the log section if the wedge-shaped blade is applied from an edge of the section to be split rather than from the center or head-on. As seen in FIG. 7B, the effect is to institute a vertical split S from the bottom of the log section toward the top which is widened as the section is driven forward by the ram.

Figure 8B:
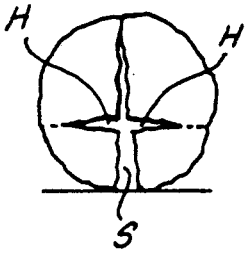
FIGS. 8B, 9B and 10B are diagrammatic front end elevations corresponding to FIGS. 7B but illustrating the condition of the log section at the positions represented in FIGS. 8A, 9A and 10A, respectively.
Figure 8A:
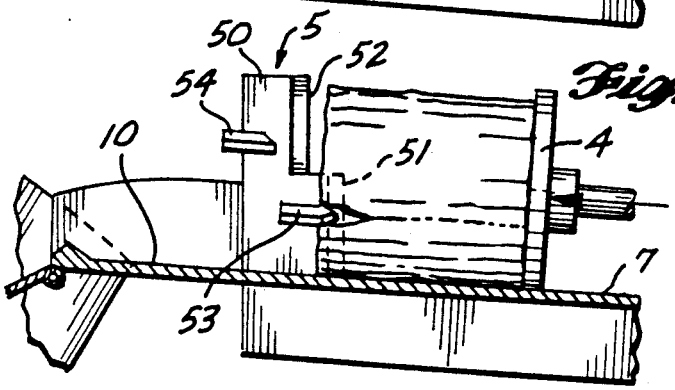
FIGS. 8A, 9A and 10A are diagrammatic fragmentary left side elevations corresponding to FIG. 7A but with the log section in different positions.

With reference to FIG. 8A and FIG. 8B, next the log section engages a pair of lower generally horizontal wings 53 cantilevered in opposite directions from the knife 50 as best seen in FIG. 1. Each wing has a sharpened edge facing the oncoming log section, spaced rearward from the upright edge 51 but in front of edge 52. The sharpened wing edges are swept back, i.e., they extend outward and rearward from the blade 50. As seen in FIGS. 8A, the wings 53 also are inclined upward and rearward at a small acute angle from their sharpened edges.

Figure 9B:
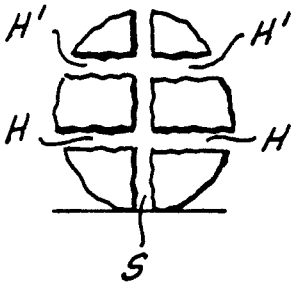
Figure 9A:
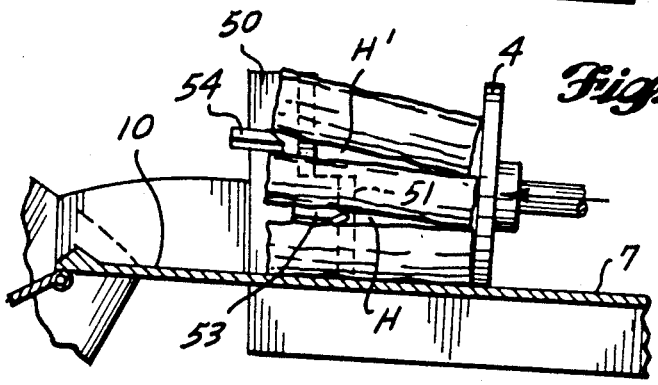
Figure 10B:
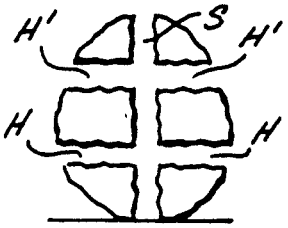
Figure 10A:
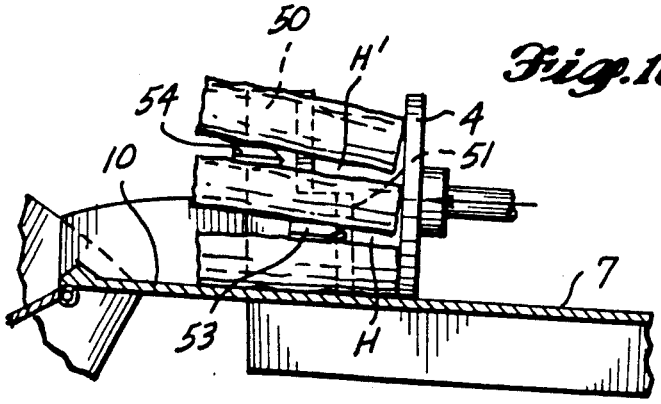

By the time the log section engages the sharpened edges of such lower wings 53, it already will be substantially split in a vertical direction. Consequently, the additional horizontal splits H instituted by such wings are again instituted from an "edge" (i.e., the edges of split S) rather than from an unsplit central portion or head-on. The inclination of the wings leaves space below for the bottom split pieces of the log section to pass beneath the wings without binding. The upper piece of the log section is peeled upward to inclined attitude, as best seen in FIG. 9A.

Next the log section engages the top upright blade edge 52 which, as noted above, also is inclined rearward to assist in widening and completing the vertical central split S.

Finally, the log section engages the sharpened edges of a pair of upper wings 54 similar to the wings 53. Wings 54 are spaced rearward from the upright edge 52, and are swept back from blade 50, as best seen in FIG. 1, and are inclined upward and rearward, as seen in FIG. 9A, so that the central split pieces will pass between the two pairs of wings with little chance of binding. The top segments above the top horizontal split H' are peeled upward over such upper wings.

At each stage of the splitting operation, the log section is split from an outside edge or the edge of a split for easiest splitting with less force. The various blades are staggered in the direction of travel of the log section to prevent several blades from engaging the unsplit log at once, which not only would require more power for the ram in order to complete the splitting operation but also would increase the possibility of a piece being jammed between blades.

Preferably, the splitter 1 is easily separable from the exit conveyor 2. With reference to FIG. 3, brackets 60 having U-shaped top openings extend upward from the box frame of the conveyor for receiving a cross shaft 61 connected to the splitter below the table 12. The drive cables 33 and 36 can be disconnected from the pusher plate and the leading end of the splitter can be rocked upward to permitting the conveyor and splitter to be separated easily. Preferably, at least one end of the conveyor is provided with casters 62 for easy transport. The splitter itself has larger wheels 63 permitting it to be trailered as is conventional.

Figure 11:
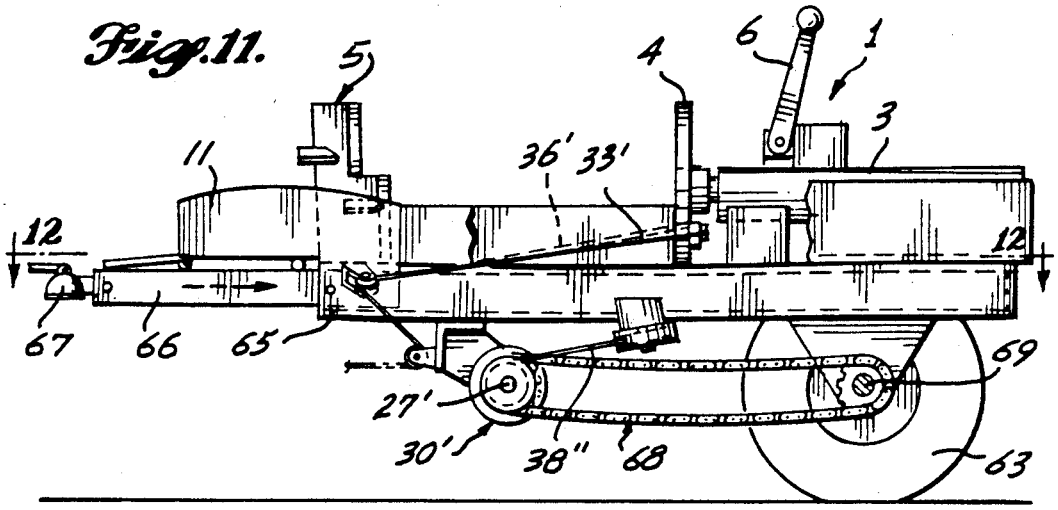
FIG. 11 is a left side elevation of a modified form of log splitter in accordance with the present invention, with parts broken away.
Figure 12:
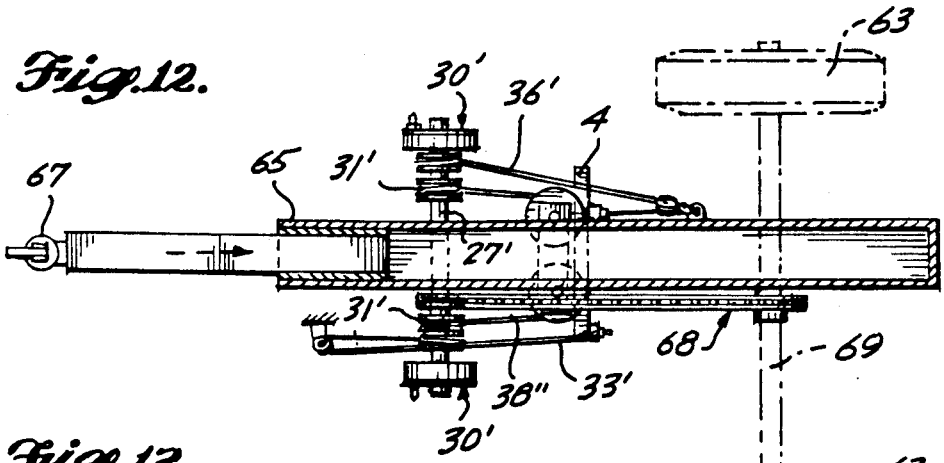
FIG. 12 is a horizontal section along line 12—12 of FIG. 11.
Figure 13:
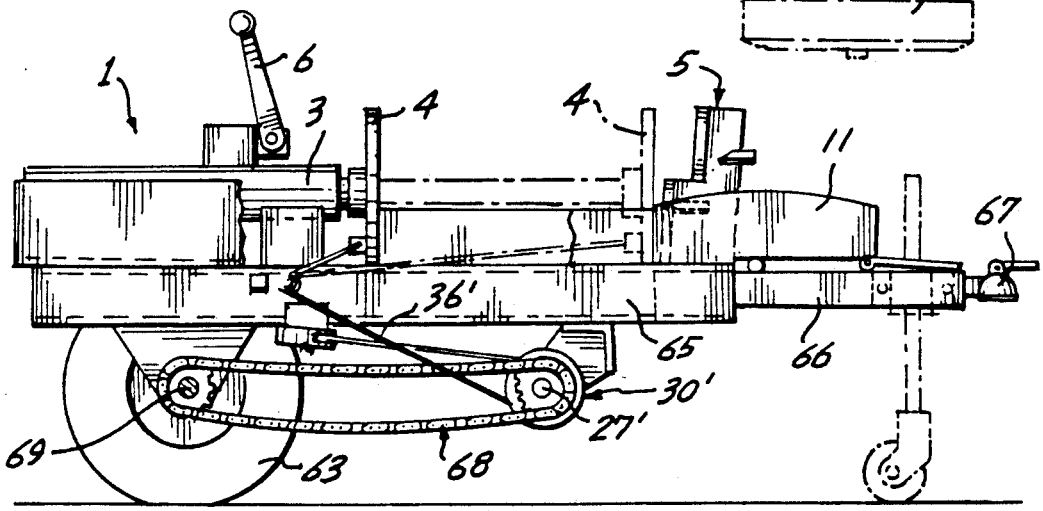
FIG. 13 is a right side elevation of the modified form of log splitter in accordance with the present invention, with parts broken away.

In the modified embodiment shown in FIGS. 11 through 13, the splitter 1 has a central box beam 65 for receiving a long tongue 66 of the type having a standard trailer socket 67. Also, drive mechanism similar to the drive mechanism provided for the exit conveyor can be included to drive the rear wheels 63 of the splitter. The splitter has a transverse drive shaft 27' with ratchet couplings 30' at its opposite ends and drive cables 33' and 36' connected to the pusher plate 4. The cable 36' at one side is effective to rotate the drive shaft 27' by forward motion of the pusher plate, whereas the cable 33' at the other side is effective to drive the drive shaft by rearward motion of the pusher plate. The nondriving ratchet coupling at one side is overrun by the drive shaft while the ratchet coupling at the other side drives the drive shaft. A rewind cable 38'' extends between inner reels 31' of the ratchet couplings, similar to the previously described embodiment. A chain and sprocket drive 68 can be connected between drive shaft 27' and the rear axle 69 for the splitter wheels 63. During normal operation cf the splitter, the ratchet couplings are released so as to freewheel regardless of movement of the pusher plate. When it is desired to move the splitter to another location or to load it onto a truck, for example, the ratchet couplings can be actuated such that reciprocating motion of the pusher plate has the effect of driving the rear wheels of the splitter to move it to the desired location.

I claim:

1. In a log splitter having a reciprocating ram for driving a block through a splitting blade to split the block into smaller pieces, the improvement comprising an exit conveyor including movable power-driven means for conveying the split pieces away from the area of the blade assembly, and means interconnecting said power-driven means with said ram for transmitting force from movement of said ram to said power-driven means to move said power-driven means.

2. In the log splitter defined in claim 1, the conveyor including an elongated carrier member extending away from the area of the blade, the power-driven means including a flight moveable along said carrier member, and the interconnecting means including means for converting reciprocating movement of the ram into incremental movement of said flight along said carrier member in a direction away from the area of the blade.

3. In the log splitter defined in claim 2, the interconnecting means including means for moving the flight away from the area of the blade simultaneously with each reciprocation of the ram.

4. In the log splitter defined in claim 2, the reciprocating ram being double-acting for movement toward and away from the splitting blade, and the interconnecting means including means for imparting movement of the flight away from the area of the blade simultaneously with movement of the ram toward the blade and simultaneously with movement of the ram away from the blade such that the flight is moved incrementally.

5. In the log splitter defined in claim 1, the reciprocating ram having an upright pusher plate movable toward and away from the blade, the exit conveyor including an elongated trough, the power-driven means including an endless conveying member having an upper run extending along the top of the trough and a lower run extending along the bottom of the trough and drive shaft means rotatable for moving said endless conveyor member, the interconnecting means including at least one ratchet coupling connected to said drive shaft and means interconnecting said coupling with said pusher plate to impart driving rotation to said drive shaft by movement of said pusher plate.

6. In the log splitter defined in claim 5, the interconnecting means including two ratchet couplings disposed at opposite end portions of the drive shaft and two drive cables interconnected with said couplings, respectively, such that forward driving rotation is imparted to the drive shaft through one of the couplings by way of one of the drive cables by movement of the pusher plate in one direction and forward driving rotation is imparted to the drive shaft by way of the other drive cable by movement of the pusher plate in the opposite direction.

7. In the log splitter defined in claim 1, the splitter including a generally horizontal rail for supporting a block to be split and a generally horizontal table below and in the area of the blade, said table having an outlet end remote from the ram, the exit conveyor having an end portion positioned below the outlet end of said table.

8. In the log splitter defined in claim 7, slide plate means extending downward from the outlet end of the table toward the exit conveyor for guiding the smaller pieces onto the exit conveyor.

9. In the log splitter defined in claim 8, the slide plate being pivotally mounted for swinging movement relative to the outlet end portion of the table.

10. In a log splitter having a double-acting reciprocating ram for driving a block through a splitting blade to split the block into smaller pieces by powered movement toward the blade and moveable away from the blade by powered movement, the improvement comprising an exit conveyor including movable power-driven means for conveying the split pieces away from the area of the blade, and means for moving said power-driven means incrementally in synchronism with the reciprocating movement of the ram.

11. A blade assembly for a log splitter having a reciprocating ram for driving a block through such assembly to split the block into smaller pieces and having a rail for supporting the block between the ram and the blade assembly, said blade assembly comprising an upright blade having a first upright splitting edge facing the ram, a first set of generally horizontal wings cantilevered in opposite directions, respectively, from said upright blade, each of said wings having a splitting edge facing the ram and spaced rearward from said first upright splitting edge relative to the direction of travel of the ram toward the blade assembly, said upright blade having a second upright splitting edge facing the ram and spaced rearward from said splitting edges of said first set of horizontal wings, and a second set of generally horizontal wings cantilevered in opposite directions, respectively, from said upright blade, each of said wings and said second set having a splitting edge facing the ram and spaced rearward from said second upright splitting edge relative to the direction of travel of the ram toward the blade assembly.

12. The blade assembly defined in claim 11, in which the splitting edges of the horizontal wings are swept back outward and rearward from the upright blade relative to the direction of travel of the ram toward the blade assembly.

13. The blade assembly defined in claim 11, in which the first upright splitting edge of the upright blade is inclined rearward relative to the rail such that as the block moves toward the blade the block will be engaged by the blade at an edge of the block.

14. The blade assembly defined in claim 13, in which the splitting edges of the horizontal wings are swept back outward and rearward from the upright blade relative to the direction of travel of the ram toward the blade assembly.

15. The blade assembly defined in claim 14, in which the first upright splitting edge of the upright blade is below the second upright splitting edge of the upright blade.

* * * * *